US005809583A

United States Patent [19]

Pucciani

[11] Patent Number: 5,809,583

[45] Date of Patent: Sep. 22, 1998

[54] TOILET WITH FOOTREST

[75] Inventor: Filippo Pucciani, Via Ripa, Italy

[73] Assignee: Daniel Affolter, Ruti, Switzerland

[21] Appl. No.: 668,101

[22] Filed: Jun. 20, 1996

[30] Foreign Application Priority Data

Jun. 26, 1995 [CH] Switzerland ..... 1862/95

[51] Int. Cl.[6] ..... E03D 11/00

[52] U.S. Cl. ..... 4/254

[58] Field of Search ..... 4/254, 237, 905

[56] References Cited

U.S. PATENT DOCUMENTS

| | | | |
|---|---|---|---|
| 951,604 | 3/1910 | Fulley | 4/254 X |
| 2,083,605 | 6/1937 | Jeitberg | 4/254 |
| 4,457,029 | 7/1984 | Matthews | 4/237 |

FOREIGN PATENT DOCUMENTS

| | | | |
|---|---|---|---|
| 0842141 | 6/1939 | France | 4/254 |
| 1045102 | 11/1953 | France | 4/254 |

*Primary Examiner*—Charles E. Phillips

*Attorney, Agent, or Firm*—Tarolli, Sundheim, Covell, Tummino & Szabo

[57] ABSTRACT

The invention provides a toilet having a toilet bowl, a toilet seat as well as two footrest members located in a certain distance above the floor, but below the toilet seat. The elongate footrest area of the footrest members extend in an angle with the central longitudinal axis of the toilet bowl. The footrest areas of the footrest members are located essentially in front of the toilet bowl. Moreover, the toilet seat is inclined with reference to the upper horizontal opening of the toilet bowl such as to slope forwardly downwards. In such a toilet, the user is enabled to take a natural, squatting sitting posture in which the angle between the thighs and the torso is between 20° and 50° during defecation; thus, the pelvic musculature is fully relaxed.

16 Claims, 6 Drawing Sheets

TOILET WITH FOOTREST

BACKGROUND OF THE INVENTION

The present invention relates generally to toilets with a toilet seat and footrest means which enable the user of the toilet to take a squatting seating posture during defecation.

Reports in international scientific magazines, pointing out that the problems during the movement of the bowels in the industrialized countries have reached nearly epidemic proportions, have been increasing during the last years. Recently published studies show that approx. 15% of all the people in Central Europe suffer from a painful movement of the bowels. Those pains reach from slight aches as far as to a blocking of the bowels and from a slight prick to a painful movement of the bowels with the need of manual help. Further, several diseases like "rectocele, anism and the descending perinaeum syndrome" are known, which appear in a disturbed movement of the bowels.

In most cases, the reason for the mentioned problems is the missing coordination of the "striated pelvic musculature". This musculature is important for the movement of the bowels. The movement of the bowels is a complex process which is controlled by the vegetative nervous system and manifests in a coordinated activity of different muscles like "striated skeletal muscles" and "smooth intestinal muscles".

Medical examinations have shown that the pains or disturbances effected by the foregoing discussed reasons may be reduced or eliminated if a squatting posture is maintained during the movement of the bowels. Such a squatting posture is still practicised in some developing countries.

During those medical examinations, it has further been noticed that the angle between the torso and the thighs reaches between 20° and 50° if an optimal squatting posture is assumed. Assuming such a posture, which corresponds to the natural squatting posture, may not be taken up on common toilets with common toilet seats.

PRIOR ART

U.S. Pat. No. 4,254,514 discloses an attachable toilet bowl seat. The forward extremity of this toilet bowl seat is provided with a downwardly and forwardly directed footrest portion which supports the feet of the user. The footrest portion is pivotally supported by a hinge. The forward end of the footrest portion further includes a depending leg, which enables adjusting the height of the footrest portion. The upper seat surface is upwardly concave in a front-to-rear extending direction. Due to the fact that the footrest portion is relatively narrow, the user has to bring his legs and feet in a parallel alignment and to press them together. Therefore, the user of such a toilet bowl seat has to remain in an unnatural posture. In this posture, the pelvic musculature gets tense and the anus channel is bent against the rectum.

It is also difficult to remain in a balanced posture on such a toilet bowl seat. Further, moving the footrest portion to an upper position rotates the footrest portion on the hinge such that the feet of the user are forced to an uncomfortable position. However, such a toilet bowl seat does not enable a comfortable natural squatting seating posture during defecation.

OBJECTS OF THE INVENTION

It is a primary object of the invention to avoid the aforementioned problems and to provide a toilet with a toilet seat which enables the user to take a natural squatting seating posture in which the angle between the thighs and the torso is between 20° and 50° during defecation, and in which the pelvic musculature gets relaxed.

It is another object of the invention to provide a toilet with a toilet seat an footrest members which can be used as a standard toilet.

It is a further object of the invention to provide a toilet with a toilet seat and footrest members such that it relieves the use of the toilet for elderly and physically handicapped people.

SUMMARY OF THE INVENTION

To meet these and other objects of the invention, there is provided a toilet arrangement comprising a toilet bowl having an essentially oval upper opening with a longitudinal axis. A toilet seat is located in the region of the oval upper opening, and two elongate footrest members each having an upper surface are arranged in a spaced apart relationship such as to extend essentially from the front of the toilet bowl.

The upper surfaces of the elongate footrest members is positioned such as to be located not more than 20 cm below the front edge of the toilet seat, whereby the longitudinal axis of each of the footrest members encloses an angle of between 10° and 35° with the longitudinal axis of the oval upper opening of the toilet bowl. Moreover, the toilet seat is inclined such as to slope downwards from the rear to the front of the oval opening of the toilet bowl.

Thus, the toilet arrangement of the invention thereby enables a user to take a natural, squatting sitting posture in which the angle between the thighs and the torso is between 20° and 50° during defecation.

BRIEF DESCRIPTION OF THE DRAWINGS

In the following, the invention will be further described, with reference to the accompanying drawings, in which some embodiments of the essential parts of the toilet according to the invention is shown. Particularly, in the drawings.

DETAILED DESCRIPTION OF THE INVENTION

Figure 1:
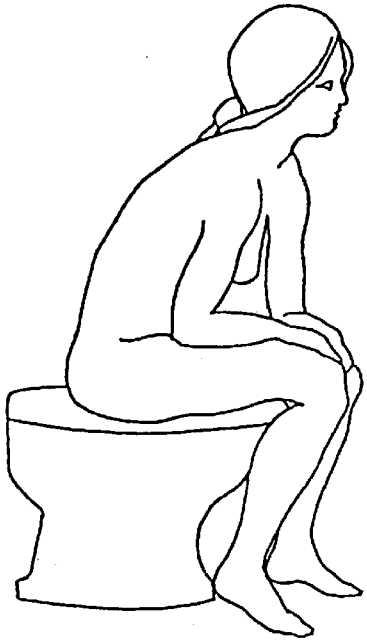
FIG. 1 is a side elevational view of a person sitting on a toilet according to the prior art.

FIG. 1 shows a person in a conventional sitting posture on a toilet according to the prior art. Such a posture is preferred by most people in the industrial countries and is the result of a natural evolution during the past centuries. In most cases such a posture is felt as comfortable.

Figure 2:
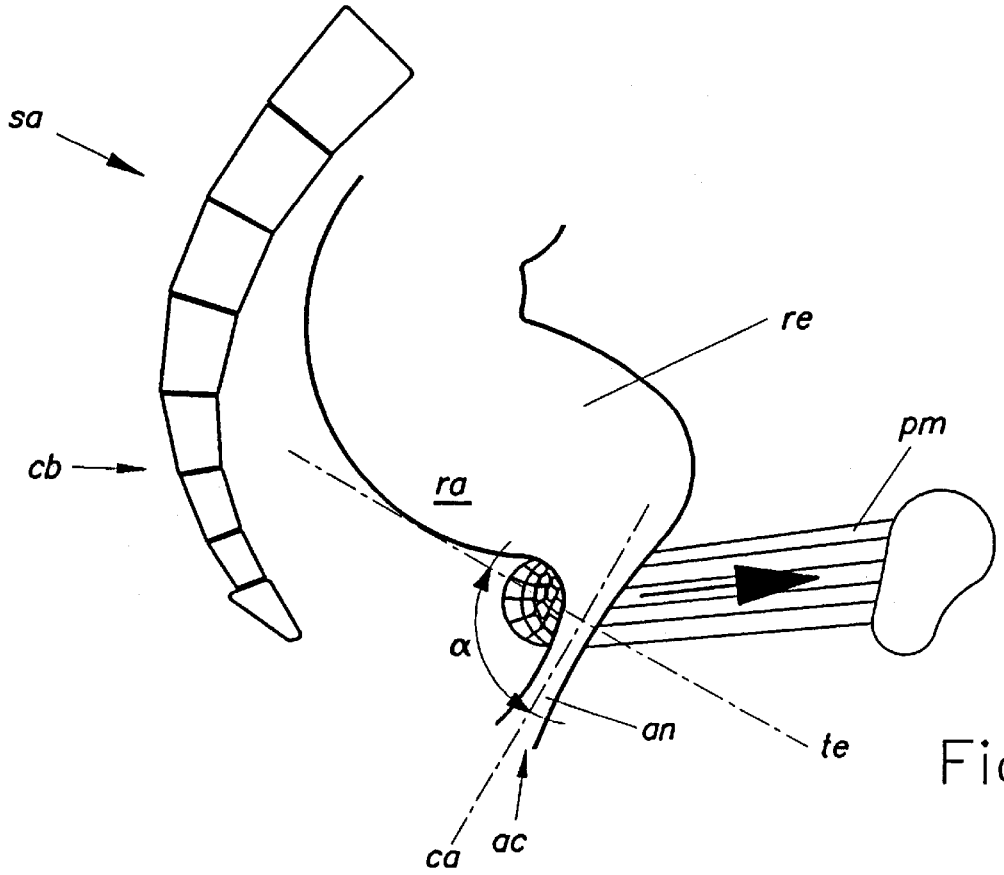
FIG. 2 is a schematic view of the anus region of a person sitting on a toilet according to FIG. 1.

FIG. 2 shows in a schematic view the anal region of a person sitting on a toilet according to FIG. 1. This illustration shows the sacrum sa, the coccyx bone cb, the puburectal muscle pm, the rectum re and the anus an.

It has been observed by radiological examinations during the movement of the bowels that the anorectal-angle, well known in the special language as ara-angle and hereinafter referred to as ara-angle α, is extremely important. With the help of this ara-angle α, it may be detected, if the anus-channel ac is in straight line with the rectum re and therefore helps evacuating the movement of the bowels or if the anus-channel ac is bent against the rectum re and therefore complicates the movement of the bowels.

The size of this ara-angle a is measured between the tangential elongation te between the beginning of the anus an and the back partition of the rectalampule ra and the central axis ca of the anus an. In the here shown posture which corresponds to a posture on a toilet according to FIG. 1, the size of the ara-angle α is about 90°. During the defecation, this ara-angle α increases to 110° due to the relaxing of the anus-muscle—puborectal muscle pm-.

An ara-angle α of 90° in the sitting posture and of 110° during the defecation indicates that the anus-channel ac is bent against the rectum re and therefore effects as a mechanical obstacle which restricts the movement of the bowels during the defecation. Therefore, it may be understood that the posture on common toilets is not optimal for the defecation.

Figure 3:
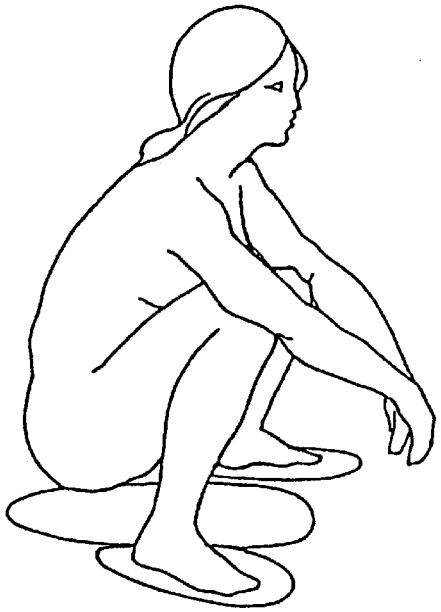
FIG. 3 is a schematic view of a person in a natural squatting posture.

A straightening of the anus-channel may be attained, if a squatting posture during the defecation is maintained as shown in FIG. 3. This natural posture may be still found in less developed countries. But, in most of the industrialized countries, a sitting posture is preferred which allows a more comfortable execution of an unpleasant act.

Figure 4:
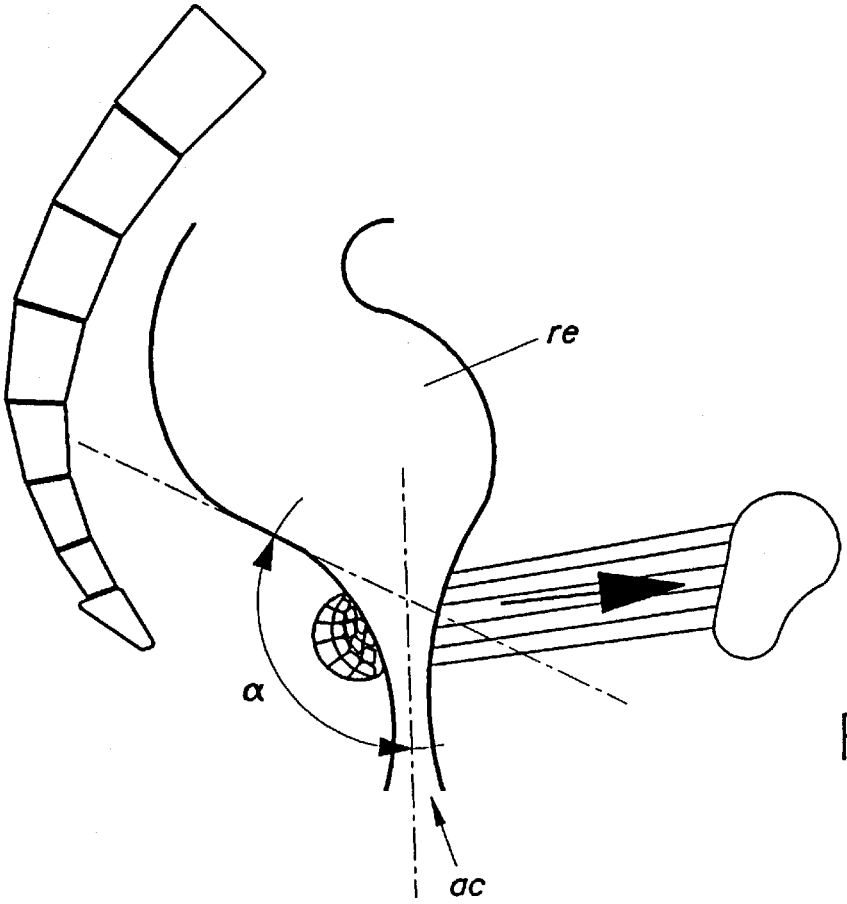
FIG. 4 is a schematic view of the anus region of a person in a squatting posture according to FIG. 3.

FIG. 4 shows in a schematic view the anus region of a person in a squatting posture according to FIG. 3. As may be seen from this illustration, the anus channel ac is more or less in a straight line with the rectum re, which results in an greater value of the ara-angle α than in FIG. 2. In the here shown squatting posture, the value of the ara-angle α is approx. 118°. This ara-angle α increases to approx. 135° during the defecation. Therefore, if the ara-angle α reaches approx. 120°, an optimal posture for defecation is reached due to an considerable alignment of the anus channel ac with the rectum re.

Normally, an ara-angle α of 120° will be reached, if the angle between the thighs and the torso is approx. 30°. This angle is measured between the femur and a straight line which leads from the sacral segment s1 to the back of the neck.

Figure 5:
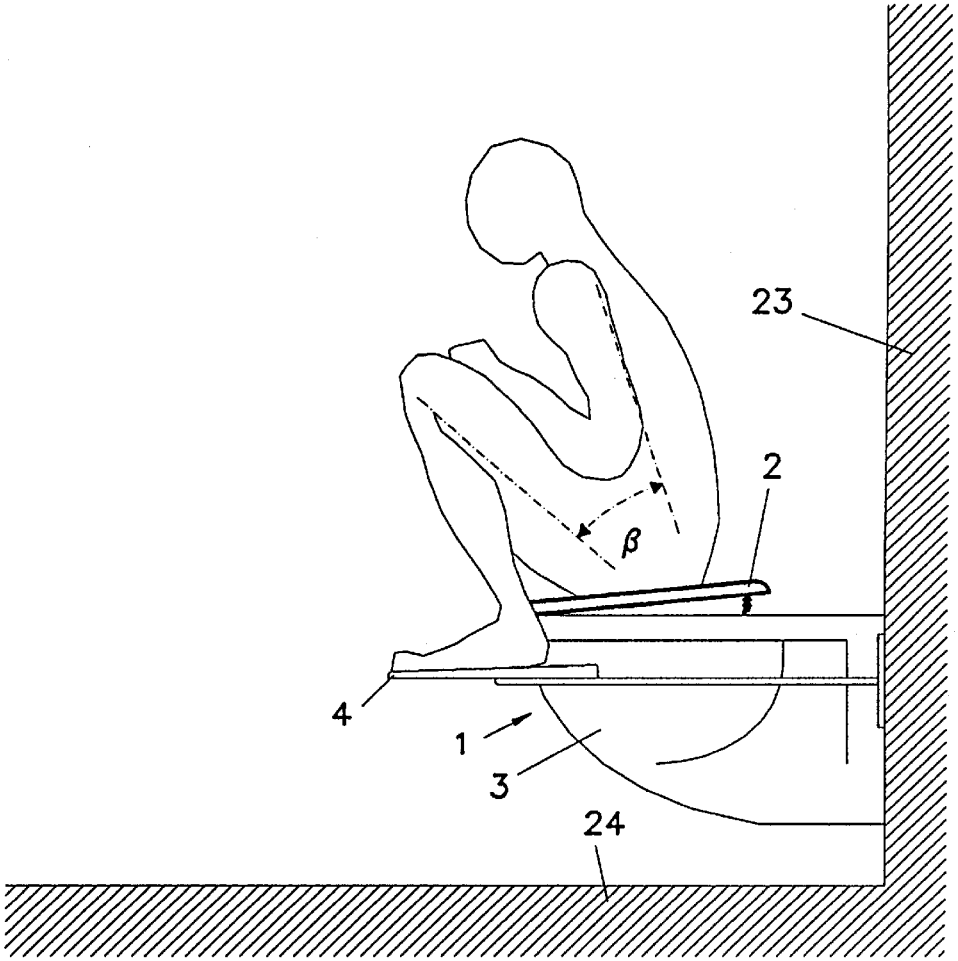
FIG. 5 is a schematic side elevational view of a toilet with footrest members.
Figure 6:
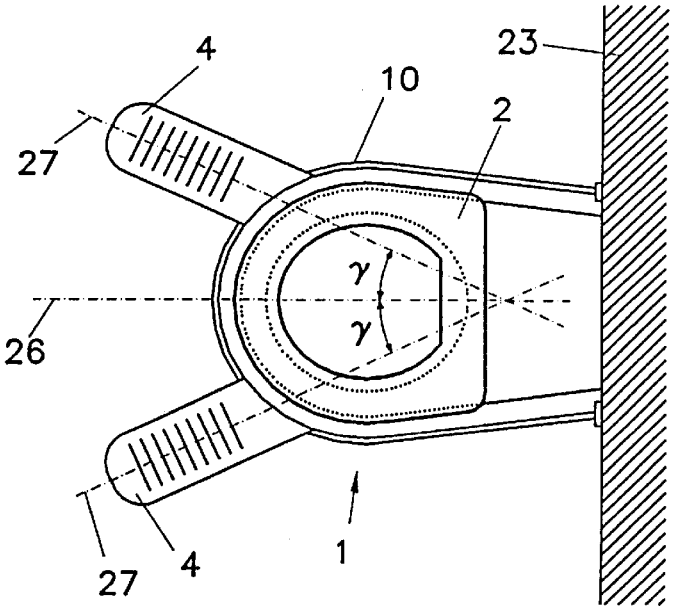
FIG. 6 is a top view of the toilet according to FIG. 5.

FIG. 5 is a side elevational view of a first embodiment of a toilet with footrest members and FIG. 6 is a top view of the toilet according to FIG. 5. According to a common toilet, which is wide spread in these days, the toilet 1 comprises a toilet basin 3 and a toilet seat 2. The toilet seat 2 is inclined to its front with regard to the horizontal plane. Further, two footrest members 4 are provided, which are spaced apart and displaced against the floor 24. In the here shown embodiment, the footrest members 4 are positioned approx. 10 cm below the front edge of the toilet seat 2. The center of the footrest members 4 or of the portion on which the feet of the user are positioned, respectively, is located approx. 10–15 cm in front of the front edge of the toilet seat 2. It must be considered that all these mentioned distances may vary within a range of ±10 cm for example.

Further, both of the footrest members 4 are positioned such that their longitudinal axes 27 extend in a certain angle with regard to the longitudinal axis 26 of the toilet 1. The angle γ between the the longitudinal axis 27 of the footrest members 4 and the longitudinal axis 26 of the toilet 1 is approx. 23°, but this angle also may vary within a range of 10°–35° for example.

For fixing the footrest members 4, a frame 10 is provided. This frame 10 surrounds the toilet 1 and is fixed on both sides of the toilet 1 to the wall 23. The posture, in which a toilet user seats on the suggested toilet 1, is schematically indicated in the drawing. If the toilet user is sitting on the toilet 1 with his feet positioned on the footrest members 4, the posture is adequate to the squatting posture shown in FIG. 3, whereby the toilet user may remain in a more comfortable sitting posture in which the pelvic musculature gets relaxed. For an optimal defecation posture, the angle between the torso and the thighs should reach approx. 30°, which leads to an ara-angle α of approx. 120° (FIG. 4) and therefore to a straightening of the anus-channel with the rectum as described herein before. The inclination of the toilet seat 2 allows the user of the toilet to remain in a safe and comfortable posture as shown in this illustration .

Further, the angled position of the footrest members 4 helps the user of the toilet to remain in a natural posture. It is important to position the footrest members 4 in an angled orientation with regard to the longitudinal axis 26 of the toilet 1, due to the fact that it helps additionally to relax the pelvic musculature. Further, the footrest members 4 may be arranged in an inclined position in which they are preferably inclined from the front to the rear.

To support the back of the toilet user in a defined posture on the toilet, a support, not shown, may be provided.

Figure 7:
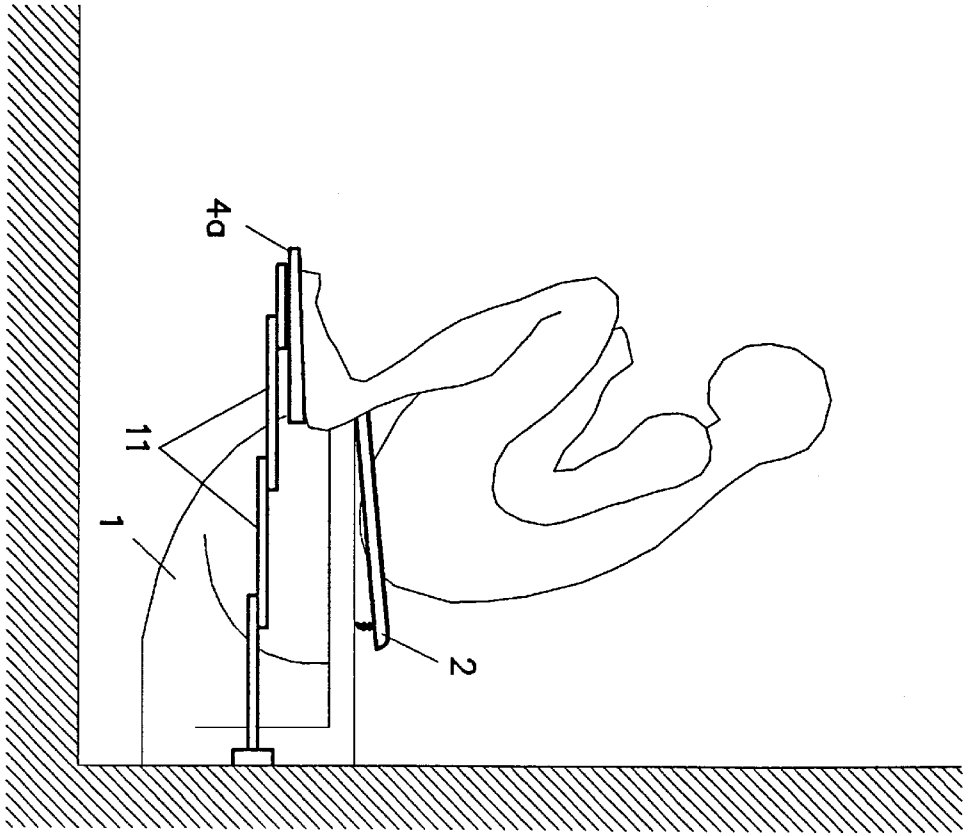
FIG. 7 is a schematic side elevational view of a second embodiment of a toilet with footrest members.
Figure 8:
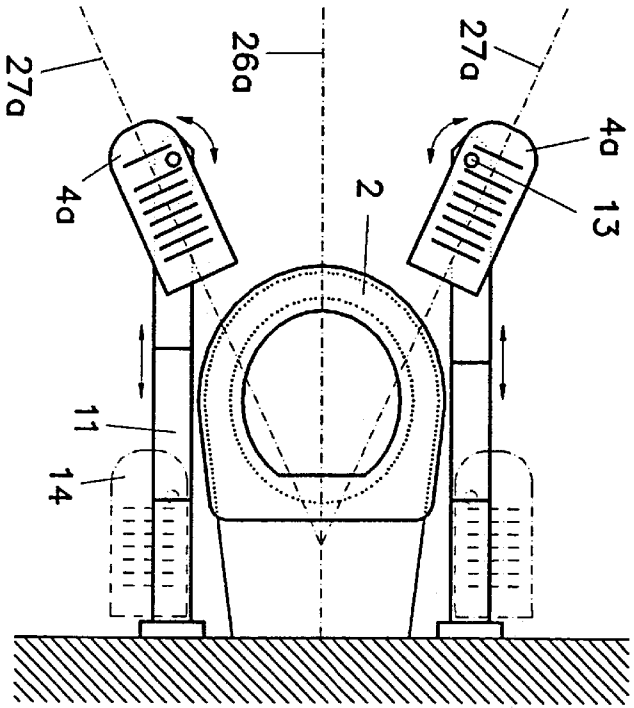
FIG. 8 is a top view of the toilet according to FIG. 7.

FIG. 7 is a schematic side elevational view of a second embodiment of a toilet with footrest members 4*a,* and FIG. 8 is a top view of the toilet according to FIG. 7. Contrary to the foregoing example, the footrest members 4*a* are arranged movable. To move the footrest members 4*a* between the here shown operating position and a rest position, shown in broken lines 14, a telescopic pull out member 11 is provided to which the footrest members 4*a* are fixed. Both footrest members 4*a* are pivotally secured on the pull out member 11, such that the footrest members 4*a* may be turned to the here shown operating position, in which their longitudinal axis 27*a* encloses an angle with the longitudinal axis 26*a* of the toilet 1.

Figure 9:
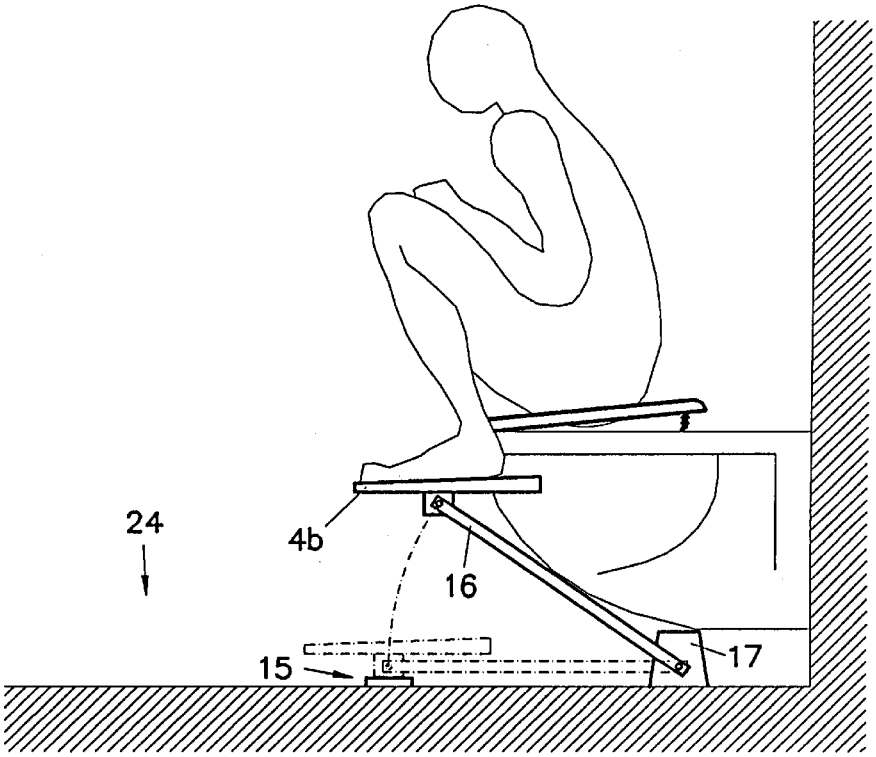
FIG. 9 is a schematic side elevational view of a third embodiment of a toilet with footrest members.

FIG. 9 is a schematic side elevational view of a third embodiment of a toilet with footrest members 4*b*. Also in this embodiment, two footrest members 4*b* are provided, each of them fixed on a lever 16. Both levers 16 are pivotally secured to a pivot bearing 17 attached on the floor 24. Such an arrangement allows to rotate the footrest members 4*b* from a lower rest position to an upper operating position. Further, such an arrangement may be provided with an electrically driven device, not shown, which allows to move the footrest members 4*b* automatically from the rest position to the operating position.

For a synchronous movement of the two footrest members 4*b,* both levers 16 may be coupled to each other by a shaft, not shown. Such a coupling has the advantage that only one electric motor is required. The actuation of the electric motor may occur e.g. by an electrical switch, not shown, operated by the user of the toilet. Further, such a toilet may be provided with a sensor, not shown, which detects if the toilet or the toilet seat, respectively, is occupied by a user. The sensor-signal, toilet occupied, may be transmitted to the electric motor by an electronic array, such that the footrest members 4*b* move from the rest position to the operating position after a toilet user has been seated on the toilet seat. Preferably, such a toilet may be used by elderly and physically handicapped people. It is obvious that an arrangement as herein before described may be used with all kinds of toilets as suggested.

To enable the footrest members 4*b* to remain in a more or less horizontal position during the movement from the rest to the operating position, both footrest members 4*b* are pivotally secured to the levers 16. The posture, in which a toilet user remains if the footrest members 4*b* are in the here shown operating position, is shown in outlines. To support the footrest members 4*b* in the rest position, two stoppers 15 are provided, which are fixed to the floor 24.

Figure 10:
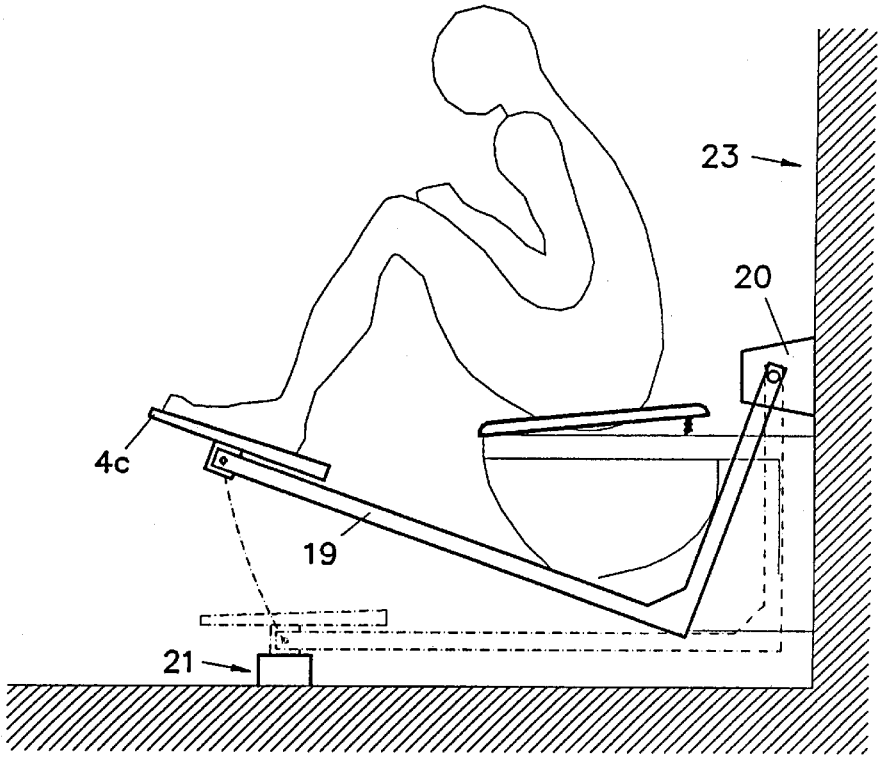
FIG. 10 is a schematic side elevational view of a forth embodiment of a toilet with footrest members.

FIG. 10 is a schematic side elevational view of a forth embodiment of a toilet with footrest members 4*c*. This embodiment is provided with a L-shaped lift up frame 19, to which two footrest members 4*c* are fixed. The L-shaped lift up frame 19 is pivotally secured by mechanical means 20 to the wall 23. Contrary to the foregoing illustrations wherein the footrest members 4*c* were moved backwards to the wall during the lifting from the rest to the operating position, the footrest members 4*c* are moved forward in a horizontally direction during the lifting from the rest to the operating position in this illustration.

Further, it may be seen in this drawing, that only the angle between the torso and the thighs is important for an optimal posture during defecation and that the angle between the lower legs and the thighs is not relevant. In the here shown posture of the toilet user, an angle of approx. 30° between the torso and the thighs is adhered which leads to the desired straightening of the anus channel against the rectum. On the floor, stoppers 21 are provided which supports the footrest members 4*c* in their rest position.

Figure 11:
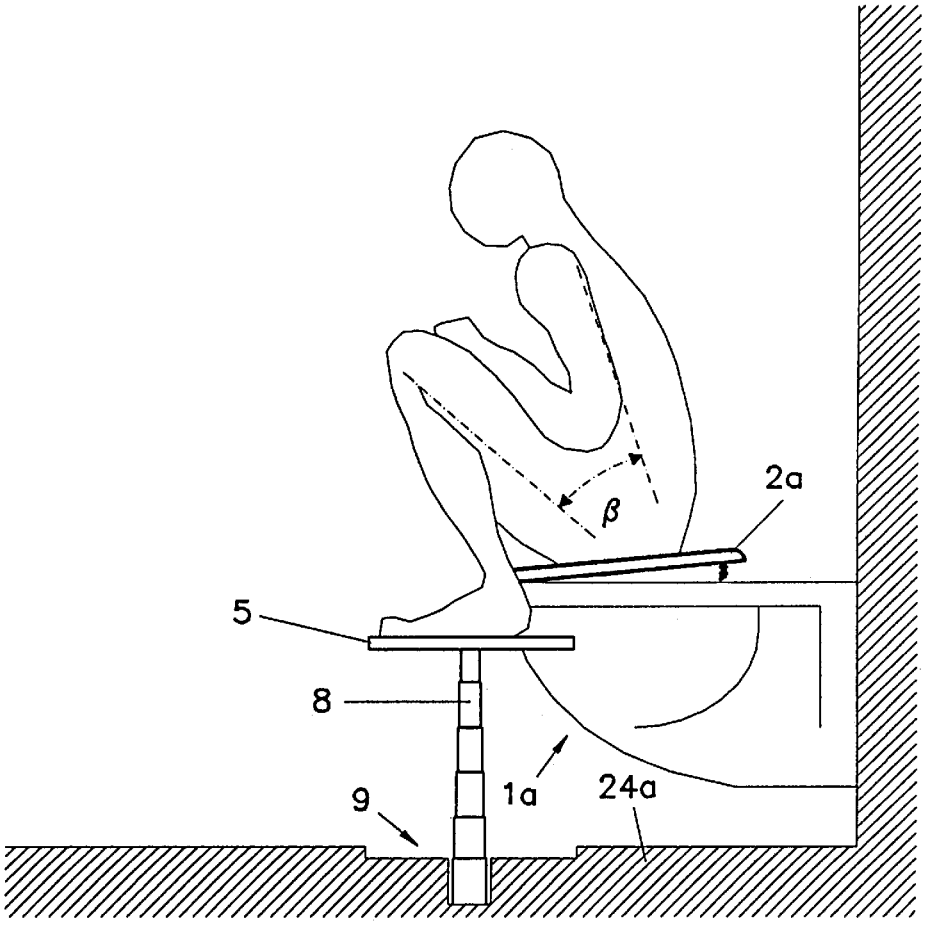
FIG. 11 is a schematic side elevational view of an alternative embodiment of a toilet with a footrest member.
Figure 12:
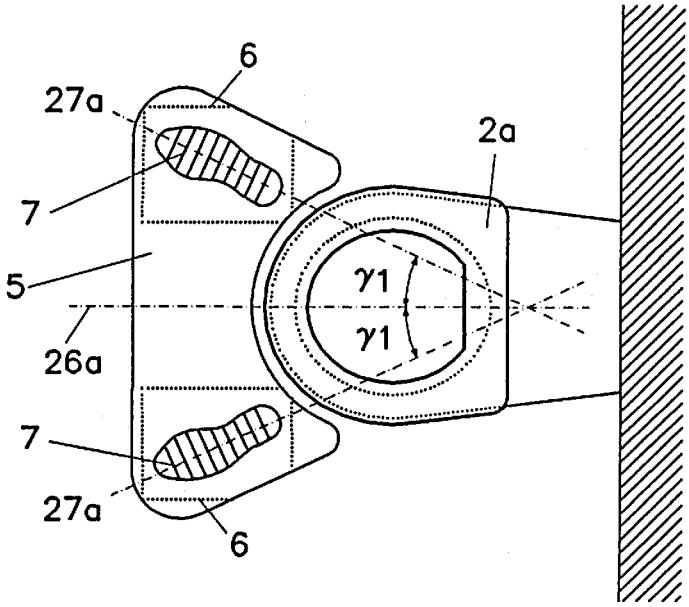
FIG. 12 is a top view of the toilet according to FIG. 11.

FIG. 11 is a schematic side elevational view of an alternative embodiment of a toilet with a footrest means 5, and FIG. 12 is a top view of the toilet according to FIG. 11. Instead of the foregoing shown toilets with two footrest members, the present toilet is provided with a platform 5 on which two footrest areas are disposed. These footrest areas 6 are indicated by broken lines 6. The platform 5 is provided with a telescopic lift up member 8 which allows to lift the platform 8 to an upper operating position or to lower to a lower rest position, respectively. In the floor 24*a*, a recess 9 is provided in which the platform 5 may be lowered in the rest position such that the platform 5 flushes with the floor 24*a*.

For lifting up the platform 5, an electric motor or a hydraulic or pneumatic system is preferably provided, but of course, it is also possible to move the platform 5 manually. The preferred position of the feet on the platform 5 is shown by footprints 7, which are disposed on the upper side of the platform 5. Alternatively or additionally to such footprints 7, mechanical means, not shown, may be provided, which enforce the feet of the toilet user in a defined position.

According to the herein before shown illustrations, the longitudinal axes 27*a* of the footrest areas 6 enclose an angle γ1 with the longitudinal axis 26*a* of the toilet 1*a*. But only the area on which the feet of the user are really placed during defecation is called footrest area. Such an area does not really has to have the here shown rectangular shape. Several different shapes, e.g. triangular or trapezium, are possible. However, for reaching a particular or a more comfortable posture, the user has the possibility to move his feet 5 within a range on the platform. The centers of the footrest areas 6 are also disposed in front of the front edge of the toilet seat 2*a*.

To enable the feet of the toilet user a safe foothold on the platform 5, the latter may be provided with a mechanical structure in the region of the footrest areas 6 which increases the friction between the platform 5 and the feet or the shoes of the toilet user, respectively.

To sum up it can be said that a toilet with a toilet seat and showing the following features:

two footrest members which are spaced apart;

the center of the footrest members are located in front of the front edge of the toilet seat;

the footrest members are positioned not more than 20 cm under the front edge of the toilet seat;

the longitudinal axis of the footrest members encloses an angle of between 10° and 35° with the longitudinal axis of the toilet, and the toilet seat is inclined toward its front against a horizontal plane, enables the user a comfortable squatting seating posture on the toilet. In such a posture, which is close to the natural posture, the pelvic musculature gets relaxed. Such a toilet may be used by persons with problems during the movement of the bowels as well as by healthy persons. The former, a defecation in the natural posture will be enabled and the latter a relief is given during the movement of the bowels with the possibility of a rehabilitation. The mentioned advantages may also be attended by toilets with a toilet seat and a platform instead of two footrest members.

It has to be considered that the foregoing examples have only illustrative character and do neither limit the invention nor cover all possibilities.

Further, also already existing common toilets may be additionally provided with the foregoing described footrest members, or a platform, as shown in the drawings and explained herein before.

What is claimed is:

1. A toilet arrangement comprising:

a toilet bowl means having an essentially oval upper opening with a longitudinal axis, a seat means located in the region of said oval upper opening, said seat means having a front end portion and an opposite rear end portion, two elongate footrest areas each having an upper surface, arranged in a spaced apart relationship and extending essentially from the front of said bowl means;

said upper surfaces of said elongate footrest areas being positionable not more than 20 cm below the front edge of said toilet seat means;

the longitudinal axis of each of said footrest areas enclosing an angle of between 10° and 35° with said longitudinal axis of said oval upper opening; and said toilet seat means being continually inclined from said rear end portion to said front end portion such as to slope downwards from the rear to the front of said oval opening of said toilet bowl;

said toilet arrangement thereby enabling a user to take a natural, squatting sitting posture in which the angle between the thighs and the torso is between 20° and 50° during defecation.

2. The toilet according to claim 1, wherein said footrest areas are movable between a lower rest position and an upper operating position in which said upper surfaces of said elongate footrest areas are positioned not more than 20 cm below the front edge of said toilet seat means.

3. The toilet according to claim 2, wherein said footrest areas are manually movable between said lower rest position and said upper operating position.

4. The toilet according to claim 1, wherein said footrest area, when in said rest position, are located closer to the wall than when said footrest area are in said operating position, shown in a horizontal direction.

5. The toilet according to claim 1, wherein said footrest areas are spaced apart by a distance of at least 20 cm.

6. The toilet according to claim 1, wherein said footrest areas are fixed in an inclined position.

7. The toilet according to claim 1, wherein said upper surfaces of said footrest areas are provided with a structure.

8. The toilet according to claim 1, further comprising support means adapted to fix said footrest areas in a predetermined position with regard to said toilet seat means.

9. The toilet according to claim 8, wherein said support means are constituted by lever means which are pivotally secured to the floor.

10. The toilet according to claim 8, wherein said support means are constituted by frame means which are pivotally secured to the rear wall.

11. A toilet arrangement, comprising:

a toilet bowl means having an essentially oval upper opening with a longitudinal axis, a seat means located in the region of said oval upper opening, said seat means having a front end portion and a rear end portion;

a platform means having an upper surface with two elongate footrest areas arranged in a spaced apart relationship, said platform means extending essentially from the front of said bowl means;

said upper surfaces of said platform means being positioned not more than 20 cm below the front edge of said toilet seat means;

the longitudinal axis of each of said footrest areas enclosing an angle of between 10° and 35° with said longitudinal axis of said oval upper opening; and said toilet seat means being continually inclined from said rear end portion to said front end portion such as to slope downwards from the rear to the front of said oval opening of said toilet bowl;

said toilet arrangement thereby enabling a user to take a natural, squatting sitting posture in which the angle between the thighs and the torso is between 20° and 50° during defecation.

12. The toilet according to claim 11, wherein said footrest areas are spaced apart by a distance of at least 20 cm.

13. The toilet according to claim 11, further comprising support means adapted to fix said platform means in a predetermined position with regard to said toilet seat means.

14. The toilet according to claim 11, wherein said upper surfaces of said footrest areas are provided with a structure.

15. The toilet according to claim 11, wherein said platform means is movable between a lower rest position and an upper operating position in which said upper surfaces of said elongate footrest areas are positioned not more than 20 cm below the front edge of said toilet seat means.

16. The toilet according to claim 15, wherein said platform means is manually movable between said lower rest position and said upper operating position.

* * * * *